United States Patent [19]

Drelichowski

[11] 4,216,880

[45] Aug. 12, 1980

[54] COLLAPSIBLE SPOUT FOR DISPENSING FLUENT MATERIALS

[76] Inventor: Marek K. Drelichowski, 105 White St., Westfield, Mass. 01085

[21] Appl. No.: 919,971

[22] Filed: Jun. 28, 1978

[51] Int. Cl.[2] ..... B65D 47/08; B65D 47/10

[52] U.S. Cl. ..... 222/83; 222/528; 222/530; 222/541

[58] Field of Search ..... 220/855 P; 222/478, 222/528, 530, 541, 524, 566, 527, 530, 83

[56] References Cited

U.S. PATENT DOCUMENTS

| | | | |
|---|---|---|---|
| 2,288,042 | 6/1942 | Spilman | 222/530 X |
| 2,617,563 | 11/1952 | Miller | 222/528 |
| 3,154,226 | 10/1964 | Petitto | 222/530 X |

FOREIGN PATENT DOCUMENTS 1338485 8/1963 France .

*Primary Examiner*—David A. Scherbel

*Attorney, Agent, or Firm*—Chapin, Neal & Dempsey

[57] ABSTRACT

Collaspsible spout for dispensing fluent materials from containers such as used for various liquids and/or granular or powdered products. The container includes a top panel provided with an aperture. A lever is pivotally disposed to selectively open and close the aperture and carries on its underside a pliant sleeve sealed at one end about the periphery of the aperture and with its other end adapted to be opened adjacent the outer end of the pivotable lever. In closed position the lever in the form of a flat strip lies generally flush atop the container and for opening the container the lever is pivoted outwardly from the top of the container, thereby automatically extending and unfolding the pliant tubular sleeve. The aperture is reclosable by swinging the strip back against the top of the container. In an alternate embodiment, the lever is disposed within the pliant sleeve and includes a cutting tip at its inner end for cutting the aperture as the lever is pivoted upwardly.

2 Claims, 10 Drawing Figures

COLLAPSIBLE SPOUT FOR DISPENSING FLUENT MATERIALS

BACKGROUND

This invention relates to disposable containers for fluent materials and also to dispenser caps which may be conveniently used on various types of containers. Various fluent substances which are marketed in predetermined quantities are usually intended to be completely used in a single application. Such containers are usually opened by piercing the top of the container using a suitable opener. This being the case, containers for such liquids as beverages and lubricating oil are usually disposable and thus not suitable for convenient storage and multiple usage. Other such containers are equipped with various pull or press tabs provided for convenient opening of the can without using a separate opener. Generally, when pouring various fluent materials from such containers to avoid spilling any of the contents, it is generally necessary to use some special type of spout or funnel such as used when pouring oil into the crankcase of an engine. It is also desirable to provide a funnel or spout for granular or powdered materials to avoid spilling such materials such as when filling salt shakers, sugar bowls or the like.

Although many containers come equipped with built-in spouts, such have not proven universally adaptable for all types of fluent materials. One shortcoming arises from the fact such spouts fail to provide a complete and effective seal with the container and some leakage of the fluent product as it is being poured from the container is the usual result. While self-contained spouts have been recognized in the prior art, such spouts are generally adapted to be disposed within the container when not in use. One such spout of rigid construction is disclosed in U.S. Pat. No. 3,856,188 and U.S. Pat. Nos. 3,951,316 and 4,000,838 disclose unfoldable pouring spouts disposed wholly within the container. Such spouts are constructed of materials which may be provided with predetermined fold lines so they can be folded against the underside of the top of the container. The spouts are generally form stable or shaped retentive and when erected by pulling through the top of the container form trough-shaped spouts not readily refoldable within the container. In addition, such previously known pouring spouts being trough-shaped are not entirely suitable for pouring fluent products into small access openings which one finds for the gas tank and crankcase of most automobiles.

Accordingly, it is the principal object of this invention to provide a collapsible pouring spout integral with containers for fluent material which overcome the drawbacks of the prior art.

It is another object of this invention to provide a pour spout of the above type having a leak-proof seal connecting the base of the spout to the container.

It is a further object of this invention to provide a container for fluent materials having a flexible pour spout which does not add measurably to the size or bulk of the container and which is disposed wholly external to the container and can be readily closed and reopened for multiple uses for the fluent product.

Still a further object of this invention is to provide a pour spout of the type which is economical to manufacture and thereby adapted for use on disposable containers.

DESCRIPTION OF THE DRAWINGS

These and other objects will become more readily apparent from the following detailed description taken in connection with the accompanying drawings in which.

DETAILED DESCRIPTION

Figure 1:
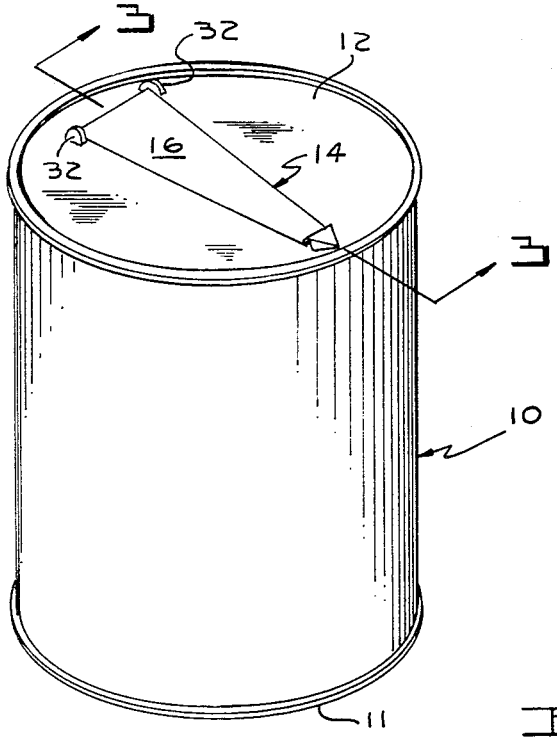
FIG. 1 is a perspective view of a dispenser container embodying the present invention.
Figure 2:
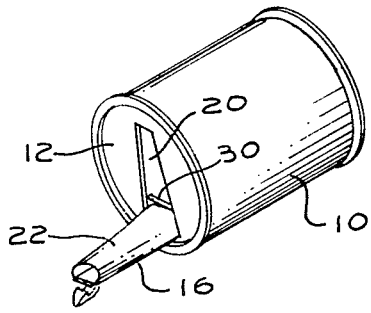
FIG. 2 is a perspective view of the container of FIG. 1 on a reduced scale, showing the container in use.
Figure 3:
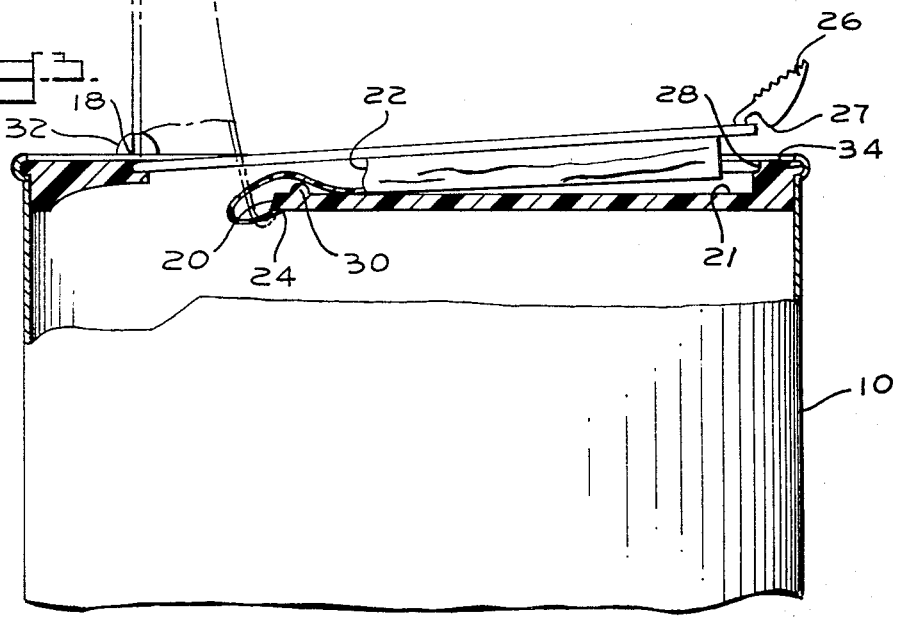
FIG. 3 is a partial sectional view on an enlarged scale taken in the direction of line 3—3 of FIG. 1.

Referring to FIGS. 1–3 of the drawings, a dispensing container 10 is shown comprising an upright cylindrical wall affixed to planar bottom and top panels 11 and 12. The top 12 may be a permanent part of the container construction or may be a separate prefabricated base member snap fitted onto the top of any open ended container. Disposed on the top of the container is a suitable combination closure and dispensing spout means indicated generally at 14.

The closure and spout means comprises a lever 16 hingedly affixed at its lower end as at 18 to the top panel 12 of the container along the outer peripheral edge portion of an aperture 20. As shown, the lever 16 is in the form of a flat strip of any suitable material such as sheet metal, plastic, paper board or combination of these materials. The selection of any particular material depends upon the composition of the container and the material must be sufficiently rigid so that it can be pivoted about its hinge 18 from the horizontal closed position shown in FIG. 1 to its upright open position shown in FIGS. 2 and 3. In closed position, the strip lies flat across the top of a container preferably within a recess 21 formed in the top of the container.

A sleeve or tubular member 22, open at both ends, is disposed along the underside of the strip 16. The outer end of the sleeve 22 terminates adjacent the outer end of the strip 18, while its lower end is sealed by any appropriate means about the periphery of the aperture 20 as shown at 24. The sleeve 22 is preferably formed of a moisture-proof, pliant film or sheet metal adaptable to be selectively expanded into tubular form when the lever strip 16 is pivoted upwardly and collapsed to a flat condition under the strip 16 within the recess 21 when the strip is pivoted to closed condition. When the container is closed, the material selected for forming the sleeve 22 must be such that it can be collapsed and expanded for multiple uses or storage. A moisture impervious plastic would be used in fabricating the sleeve if to be for pouring liquids. Suitable materials for use in fabricating the tubular sleeve 22 include synthetic plastics such as polyethylene, polypropylene, polyvinyl chloride and the like and for enhanced pliability and strength reinforcing fibers may be impregnated in the synthetic plastic material.

The outer end of the lever strip 16 is shown as having a pull tab 26 which includes a shoulder 27 adapted to act as a fulcrum for pivoting the tab 26 against the top of the can. Accordingly, when the tab 26 is pressed downwardly, the outer end of the strip 16 is pivoted upwardly about shoulder 27 and the strip is unsnapped from groove 28 formed along an upper edge portion of the recess 20. A transversely extending rib 30 extends upwardly from the bottom surface of the recess 21 adjacent the aperture 20 opposite hinge line 18. Leakage of the contents from the container is prevented by a pinching or clamping action on the portion of the sleeve 22 captured between the undersurface of the strip 16 and the rib 30.

Means is provided for releasably maintaining the spout in its open or upright position, as illustrated in FIGS. 2 and 3. In the illustrated embodiment, a lug or boss 32 is disposed on one or both side edges of the lever strip 16 so as to engage the side edges of the strip to hold it in an upright position. The inner surface of the lugs may be notched or grooved to provide detents into which the side edges of the strip will be releasably received in a snap fitting relationship.

The dispenser top 12 of the container may be formed of any suitable material as an integral part of the container as illustrated in FIG. 3, or may be fabricated and marketed as a separate article of manufacture for final assembly with the other part of a container by a container manufacturer. In this connection, the top member including the lever strip may be conveniently formed by injection molding of a synthetic plastic material. The top is formed with a suitable peripheral edge configuration for affixing the same to the upper edge of the container such as shown at 36 in FIG. 4 or 38 in FIG. 7. In the first construction, illustrated in FIG. 3, the upper edge of the can is grooved to fit around a rim in the peripheral edge of the top 12 and in other embodiments, the rim of the top panel or base may be adapted to fit over the upper edge of the container wall.

As discussed above, the lever 16 may be integrally formed when molding the base or top 12 by forming a hinge or score line 18 of reduced material thickness about which the lever may be swung. Alternatively, the strip 16 may be separately formed and bonded or otherwise affixed to the top of the container adjacent the aperture 20.

The tube 22 may also be formed integrally with the base or lever 16 or may be separately formed and sealed to the periphery of the aperture in any appropriate manner including heat sealing or by using any suitable bonding agent or adhesive. The soft and pliant character of the sleeve 22 enables it to collapse to an essentially flat condition against the outer surface of the top of the can underlying the lever strip 16. Though the sleeve is housed in a flat condition, when the container is closed, upon swinging the lever strip 16 upwardly. the sleeve 22 is automatically erected and opened to its tubular form. This result is attainable because the lower edge of the sleeve is sealed about the entire periphery of the aperture 20 and a longitudinal outer edge portion is affixed to the undersurface of the lever 16. When the lever 16 is swung toward the top of the container, the sleeve completely collapses and is pinched between the rib 30 and the undersurface of the lever. In this stored condition, moreover, the sleeve will be entirely disposed outside the container in recess 20 so that the outer surface of the sleeve is not in contact with the contents of the container. Significantly, the spout on each container embodying this invention can be employed on more than one occasion and the container can be repeatedly closed and reopened without danger of product spillage. In addition, the outer surface of the sleeve will remain clean and dry despite repeated usage since it is housed entirely outside the container.

The sleeve 22 may be economically fabricated of an inexpensive tubular plastic by simply severing selected lengths from stock. No predetermined fold or crease lines to enable it to be folded in a particular pattern for flat storage are required. Furthermore, since the spout is stored outside the container it may be formed of a substantially more pliable material than would be the case if it were necessary to reposition or reinsert the spout into the container through the aperture for successive uses.

Figure 4:
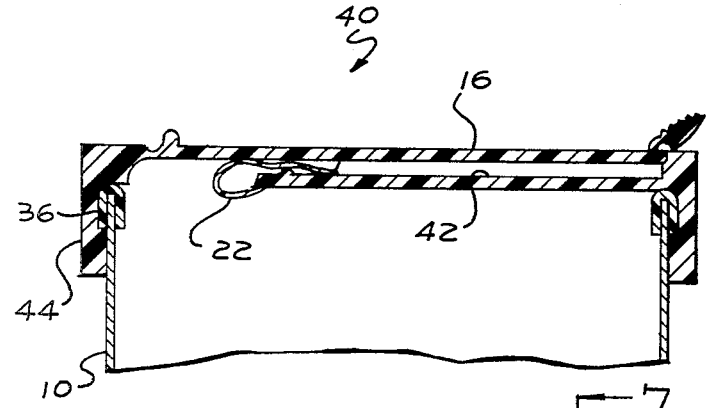
FIG. 4 is a view similar to FIG. 3 of an alternate embodiment of the invention.
Figure 5:
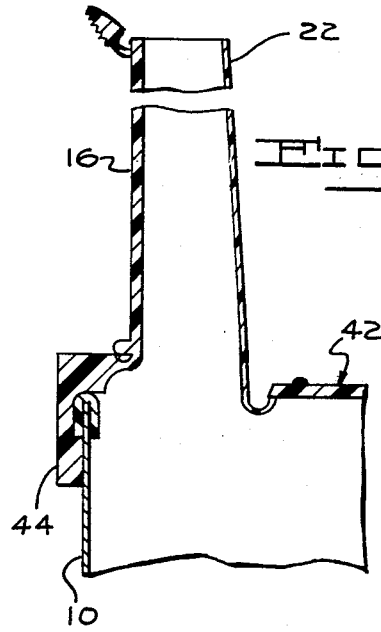
FIG. 5 is a sectional view similar to FIG. 4 but showing the component parts in different operative relationship.

Referring to FIGS. 4 and 5, a modified pour spout or cap embodying the present invention is shown at 40 provided with a base which enables dispenser top to be removed from container 10 and reused with any similar container of the same circumference. To this end, spout or dispenser cap 40 is provided with a modified base 42 having along the periphery thereof downwardly extending, depending flange 44 which resiliently grips the upper rim of the open container. The remainder of the pour spout is essentially the same as that illustrated in FIGS. 1–3 and discussed hereinabove and the same reference characters have been used to identify like parts.

Figure 6:
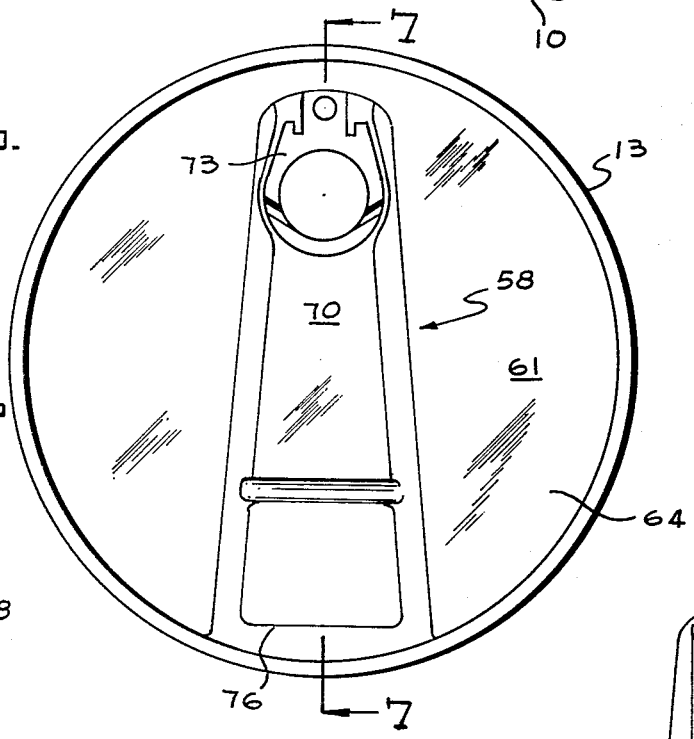
FIG. 6 is a plan view of another alternate embodiment of this invention.
Figure 7:
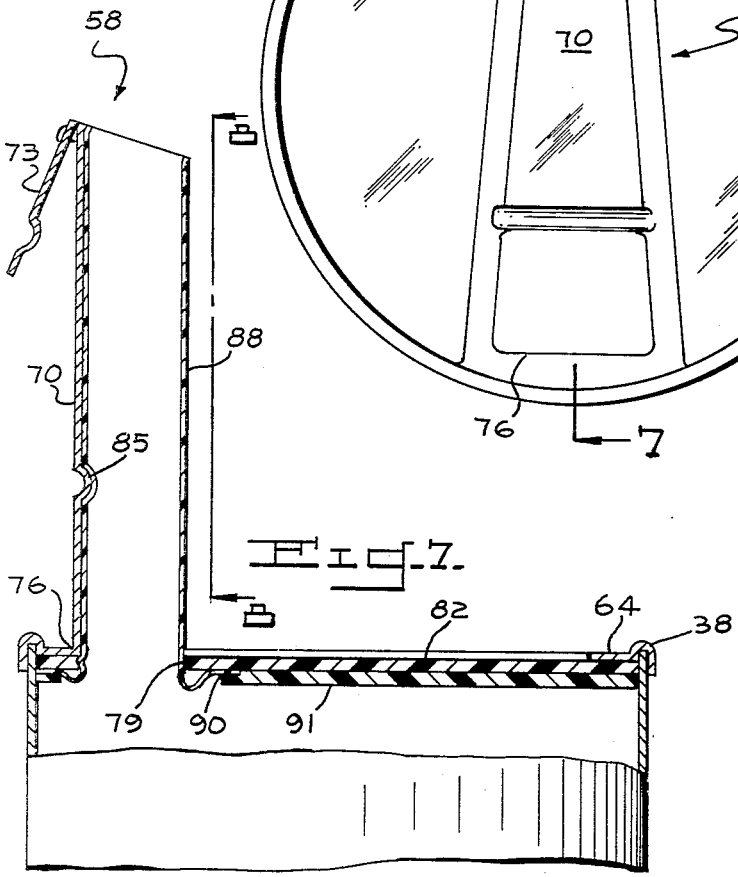
FIG. 7 is a sectional view taken in the direction of line 7—7 of FIG. 6 with the parts thereof in different operative relationship.
Figure 8:
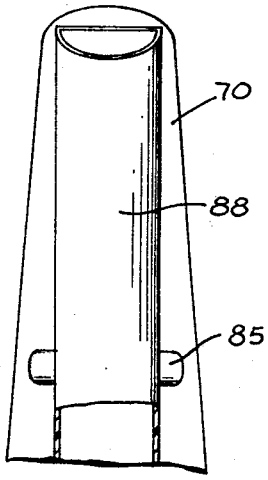
FIG. 8 is a view taken in the direction of line 8—8 of FIG. 7.

A second alternate embodiment of the pour spout of this invention is shown at 58 in FIGS. 6–8 and is particularly well adapted for permanent assembly on a disposable container, such as beverage cans and the like. Dispenser 58 includes a base 61 of the same material as the remainder of the container, the base being permanently secured as at 38 to the container rim as by crimping or other suitable technique as employed in the container industry. The top plate includes a weakened portion formed as by scoring, which weakened portion partially outlines a lever strip 70 similar to those employed in prior art "pop top" beverage cans. The strip 70 is provided with a ring 73 suitable to be grasped by a finger for pulling lever 70 upwardly for pivotal movement about hinge line 76. The lever 70 is provided with rib 85 which serves the same function as the rib 34 for pinching flexible tube 88 against the top surface of the base 61.

All of that portion of top plate 64 other than opening 79, removed by the pulling away of tab 70, is sealed by the lower plate 82 which is fixed to the top plate. The lower plate may also function as a stiffener and may be formed from any suitable material such as sheet metal or synthetic plastic and may be fixed to top plate 64 by any suitable technique.

Flexible tube 88, as is sleeve 22 discussed above, is formed from a flexible and pliant material such as thin polyethylene or other synthetic plastic and is fixed along one side thereof to the pull tab which automatically unfolds and extends the tube when opened. The tube 88 is provided with an outwardly extending flange 90 which may be sealed to the base around opening 79 by bonding or adhesive technique. Alternatively, the lower edge of the spout may be captured at the underside of the base by a clamping disc 91 secured in any convenient manner to lower plate 82. In a closed condition, the spout 88 is folded under pull tab 70. If desired to insure sealing the contents of the container, the spout may be closed or sealed at its outer end and opened simply by cutting off the end of the sleeve.

Figure 9:
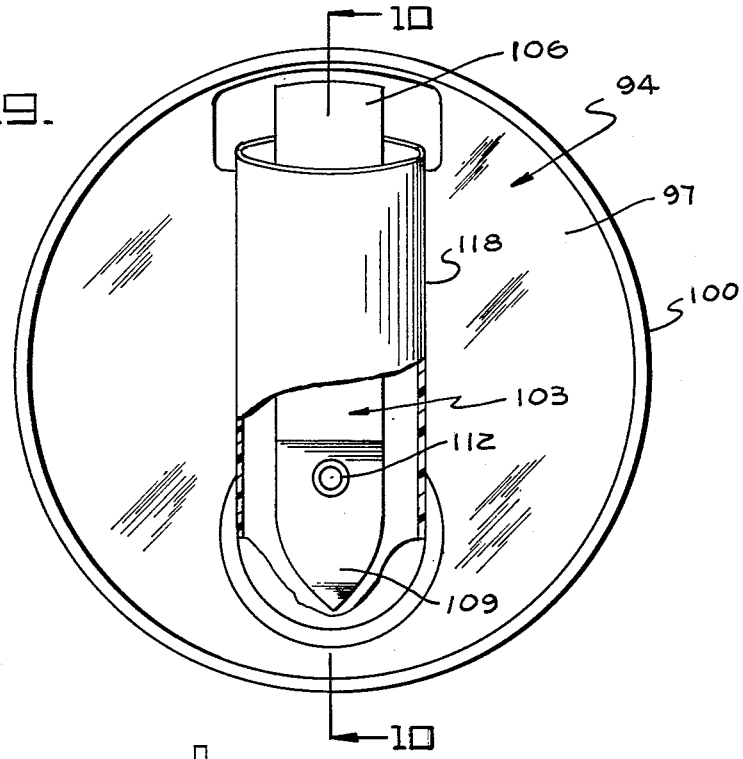
FIG. 9 is a plan view of a dispenser container illustrative of a third embodiment of the invention with parts in section to show constructional details.
Figure 10:
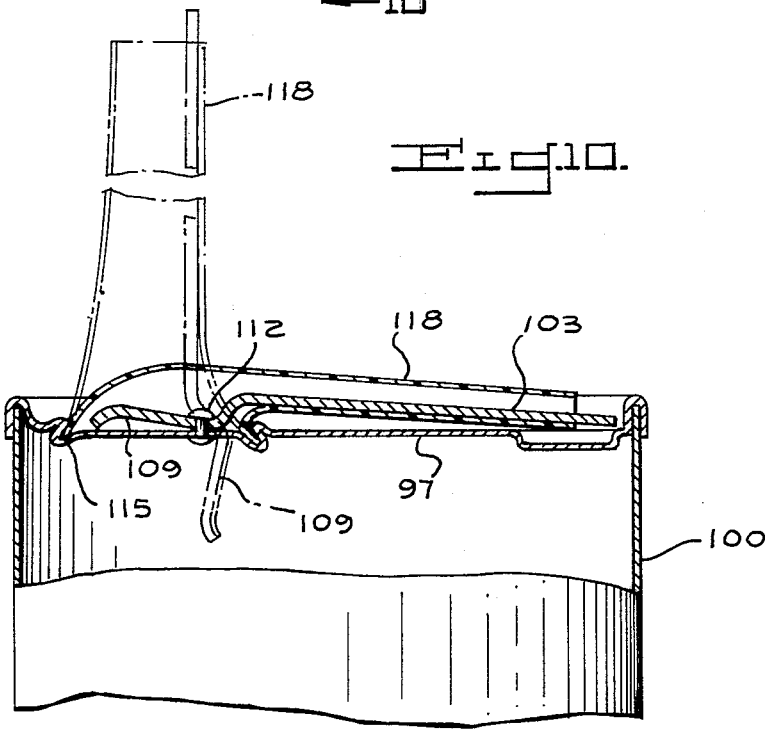
FIG. 10 is a sectional view taken in the direction of line 10—10 of FIG. 9.

A third embodiment of the dispenser of the present invention is illustrated at 94 in FIGS. 9 and 10 and comprises a base or panel 97 of sheet metal or the like fixed to a can or similar container 100 as by crimping. Base 97 is imperforate and an opening therethrough is provided by piercing when the lever 103 is operated or pivoted upwardly. The lever attached to the base by fastener 112 includes a handle portion 106 and a triangular shaped cutter 109. Lever 103 is disposed within the interior of the flexible spout so that upon operation of the lever in opening the container, the lever automatically causes the unfolding, erection and opening of tubular spout 118. As shown in phantom in FIG. 10, lifting handle 106 causes the opener lever to swing about its pivotal connection with the base, and the cutter 109 simultaneously pierces the can to form an opening in the manner of the "church key" type beer can opener.

The lower edge of the sleeve 118 is attached to the base as at 115 about the periphery to be pierced by cutter 109.

Having thus described the invention, what is claimed is:

1. Dispenser for fluent material containers having a portion for providing an aperture in the top of said container, said dispenser comprising a lever, the inner end of which being in the form of a cutter, said lever being pivotally mounted intermediate its end portions to said aperture portion and pivotable between a first position disposed generally parallel to and spanning said container portion and a second position extending upright from the top of said container wherein said cutter end pierces the top of said container to form said aperture, said dispenser further comprising a pliant sleeve within which said lever is longitudinally disposed, said sleeve being affixed at one end thereof about the periphery of said aperture so that the interior of said container communicates with said sleeve, the outer end of said sleeve disposed adjacent the outer end of said lever and being adapted to be open, said sleeve being collapsible to substantially flat condition in said first position for closing said aperture, wherein a portion of said sleeve is disposed between the top of said container and the undersurface of said lever, pivotable movement of said lever to its second position causing the opening of said sleeve into an upstanding tubular pour spout for said container.

2. Dispenser for fluent material containers having a portion for providing an aperture in the top of said container comprising a lever in the form of a generally flat strip including a pull tab at the outer end thereof, said lever being pivotably disposed adjacent an edge portion of the aperture, said lever being pivotable between a first position disposed generally parallel to and spanning said container portion and a second position extending upright from the top of said container, said dispenser further including a pliant sleeve affixed along one longitudinal portion thereof to the underside of said lever and affixed at one end thereof about the periphery of said aperture so that the interior of said container communicates with the interior of said sleeve, the outer end of said sleeve disposed adjacent the outer end of said lever and being adapted to be open, said dispenser further including a recess provided in the top of said container, said recess being adapted to receive said strip and to accommodate said sleeve in flat, collapsed condition, beneath said strip for closing said aperture, said dispenser further including means for releasably retaining said lever in an upright position relative to the top of said container, pivotable movement of said lever to its upright position causing the opening of said sleeve into an upstanding tubular pour spout for said container.

* * * * *